US005320378A

United States Patent [19]

Wiig

[11] Patent Number: 5,320,378

[45] Date of Patent: Jun. 14, 1994

[54] SNOWBOARD

[76] Inventor: Jeffrey R. Wiig, 9477 N. Opal, Mentone, Calif. 92359

[21] Appl. No.: 756,213

[22] Filed: Sep. 5, 1991

[51] Int. Cl.[5] ..... A63C 5/04

[52] U.S. Cl. ..... 280/610; 280/14.2

[58] Field of Search ..... 280/608, 609, 610, 14.2; 441/70

[56] References Cited

U.S. PATENT DOCUMENTS 3,272,522 9/1966 Kennedy, III ..... 280/610

4,974,868 12/1990 Morris ..... 280/14.2

4,995,631 2/1991 Hunter ..... 280/14.2

*Primary Examiner*—Richard M. Camby

*Attorney, Agent, or Firm*—Donald D. Mon; Stephen R. Seccombe

[57] ABSTRACT

A snowboard with a recessed bottom and upturned edges is provided to house a specialized base. The base consists of a metal plate between the longitudinal edges of the bottom with a plastic coating over it. The base is slick when wet and resilient enough to resist blows and abrasion.

16 Claims, 2 Drawing Sheets

SNOWBOARD

FIELD OF THE INVENTION

This invention relates to the sport of snowboarding, and in particular to the construction of a snowboard for use in the sport.

BACKGROUND OF THE INVENTION

Snowboarding is a sport of relatively recent emergence. Only one snowboard is used at a time by the rider. Each board has two bindings for its rider, both of whose feet are thereby bound to the board. The rider does not have poles or any other implement to be used by his hands. His feet are firmly bound to the board, and his path and circumstances are entirely determined by the contortions and extortions of his body respective to the contours of the path (course) which he intends to traverse.

The paths or courses which the snowboarder may wish to traverse can extend in type and complexity from the simplest of bunny slopes to semi-cylindrical channels in which leaps, loops and inversions are frequently attempted. The complexity attainable depends heavily on the athleticism of the snowboarder, and also to a surprising extent on the properties of the snowboard itself.

It is tempting to regard the snowboard as simply a species of a surfboard, a belly board, or of a water ski or a snow ski. However, on reflection one can appreciate the very substantial differences in their intended structural properties, and also in the way they are used.

For example, a surfboard is intended to be a large quite thick, buoyant and rigid body. It needs to be all of these because the surfer rests and paddles on it most of the time. When he catches a wave, he stands freely on the board, actually walking up and down its length much of the time. His ability to remain with the board depends on the dynamics of the wave, and on his sense of balance. Flexibility of the board, or a rigid binding to the board would be the farthest thing from his mind. In the course of rides of the better riders, there may be quite vigorous maneuvers. Also, during or at the end of many rides, he has either fallen off the board, got back on it, or jumped off of it and must get it back through the waves, hopefully before it has struck some object which might damage it.

While belly boards are rarely subject to the same extreme maneuvers of a surfboard, and the rider only rests on it, still it must float and be quite rigid.

Snow skis face many of the same conditions as snowboards in that they are used on snowy surfaces which while they are sometimes soft, are often quite hard and icy. Also, when the snow starts to disappear, there are regions in which the skier will find himself which are at least partly rocky or sandy. The speeds are very substantial, and the bending forces on the ski can often be quite large. Some bending and conformity to a surface are needed for structural integrity and for control, but not much. Rigidity of the ski is needed for proper control. Still, the conventional ski has only one foot bound to it, and the user has ski poles to assist him in maintaining his balance and directional control.

A water skier faces many of the same problems as the snow skier. While the water skier does not have poles, he has the towing rope as a reference and source of propulsion. He can move his hand grip around for balance purposes. The snowboarder has none of these advantages. He is simply on his way down a slope with only his balance and the snowboard features to help him.

The snowboard and snowboarder face an entirely different set of conditions from the above other sports. He is bound to the board. Thus, when he goes into sharp bends or markedly curved surfaces, he must have some compliance of the board, because most of the board will still be in contact with the surface. His weight, which is amplified by centrifugal forces is exerted near the center of the board, and reasonable flexibility of the board is needed in order to avoid sharp digging into the surfaces and probably falling, and to enable its orientation relative to the surface to be varied.

Snowboards are generally several feet long and about one foot wide. The stresses on the board can be quite severe. Furthermore, the board must run along surfaces which may include sand and rocks, as well as hard ice and snow. Abrasion on the bottom of the board must be resisted, while at the same time the bottom surface must provide a suitably slick surface so the board can freely slide on the surface.

Further to complicate matters is the need for reasonably sharp running and active edges, but edges still which have a suitable useful life, even in view of the stringencies to which they are exposed.

These objectives must all be met in a board which preferably is light-weight, less than one-half inch thick, and one which provides an optimum response to the stringencies of its intended use, and which enables the snowboarder to exert an increased level of control over his travel.

BRIEF DESCRIPTION OF THE INVENTION

A snowboard according to this invention has a longitudinal axis and a lateral axis normal to it. A metal base plate extends for the full longitudinal and lateral extent. Its downwardly-facing surface has a recess between two exposed bottom-facing longitudinally extending surfaces which terminate at respective edges of the snowboard.

Between these running surfaces and within the recess is a running layer of abrasion-resistant but relatively slick plastic material. This material is reasonably abrasion-resistant, and can readily be replenished as it wears out without having to refinish or patch the metal base plate itself. This plastic material will be relatively hard in order to provide for best wear.

At each edge, rising above the metal plate is a rail member. This is preferably made of a stiffly deformable plastic material that can form a sharper and thicker edge along with the metal base plate. It is slick when wet, to give best running control conditions. It is compliant enough to bend with the metal base plate, and resilient enough to resist excessive damage from blows or abrasion.

Between the two rail members, atop the metal plate is a succession of longitudinally-extending strips, alternately of wood and of plastic foam. Wood strips are placed adjacent to the rail members.

A water-impermeable cover is laid over the top of the strips and rail members. The rail members, strips, and cover, are mutually bonded together, and as a group are bonded to the top of the metal plate.

Bindings can be attached by any desired means. The contour of the snowboard is a matter of design. Some boards may have tapered tip and tail ends, uptilted tip and tail ends, and a camber in the longitudinal axis.

BRIEF DESCRIPTION OF THE INVENTION

DETAILED DESCRIPTION OF THE INVENTION

Figure 1:
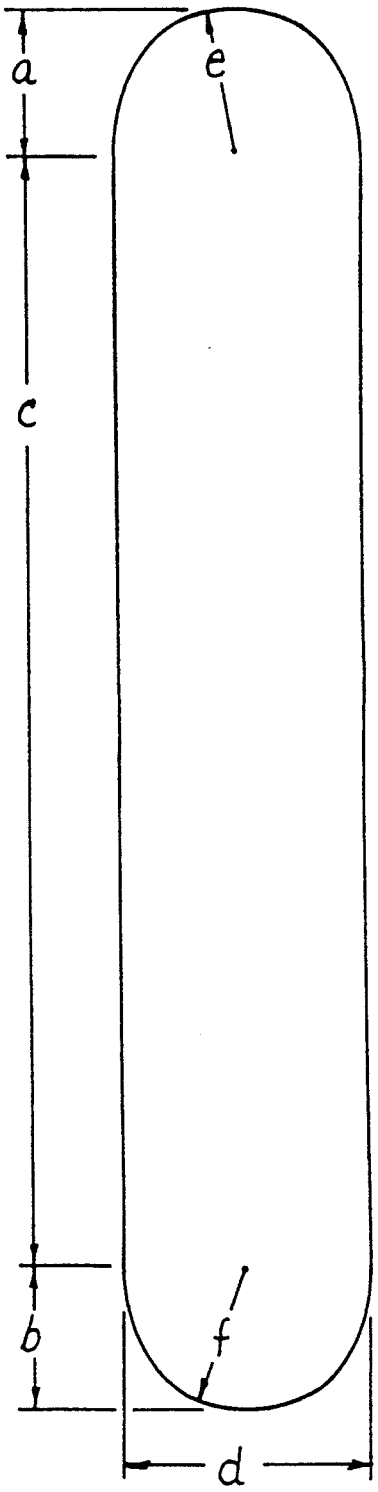
FIG. 1 is a plan view of the presently preferred embodiment of the invention.

In FIG. 1 there is shown the presently-preferred embodiment of a snowboard 10 according to the invention. It has a forward longitudinal axis 11 of intended relative motion, and a lateral axis 12 normal to it. It has a tip end 13 and a tail end 14.

The board has a left hand running edge 21 and a right hand running edge 22. Edges 21 and 22 will generally be parallel to one another in the central portion 20 of the board, or deployed only a few degrees from parallelism.

At the tip end 13, the running edges taper toward each other in plan view, usually but not necessarily in a circular arc. At the tail end 14, the running edges also taper toward each other in plan view, usually but not necessarily in a circular arc. Preferably at the intersections of the straight and curved portions the straight portion of the edges are slightly joggled inwardly toward the axis.

Figure 2:
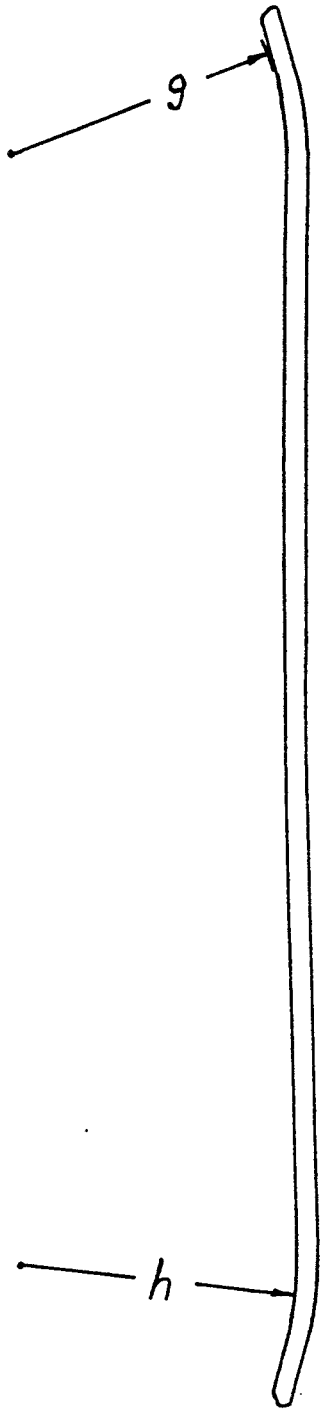
FIG. 2 is a right hand side view of FIG. 1.

As shown in FIG. 2, the tip end and tail end are tipped slightly upward so the leading and trailing tailing ends are somewhat above the plane of the central region 20. This provides a significant improvement in steerability of the board. As shown, the radius of curvature of the upward tip (it is preferably curved) is quite large - usually about 13 inches for a relatively short arc. The tip end and tail end will thereby rise above the level of the central region only about 1 inch or less. Too much rise results in a board which is too sensitive in use.

The board is cambered in its longitudinal axis so that it is concave downwardly when not loaded. FIG. 2 shows the unloaded condition. When the rider stands on it, the board tends to flatten out. When he is jumping or otherwise not in contact with the snow or other surface on which he is riding, or only in light contact with it, the board reverts to its cambered shape, so as to improve steerability at the moment of initial contact with the snow surface.

From the foregoing it will be appreciated that the configuration of board surface contour and edge shapes respective to the surface on which the snowboard is used are of primary importance, and that these must vary as the dynamic loads vary. In addition, the board must be strong enough to withstand these widely varying forces without permanent deformation, and preferably with minimum surface wear.

Figure 3:
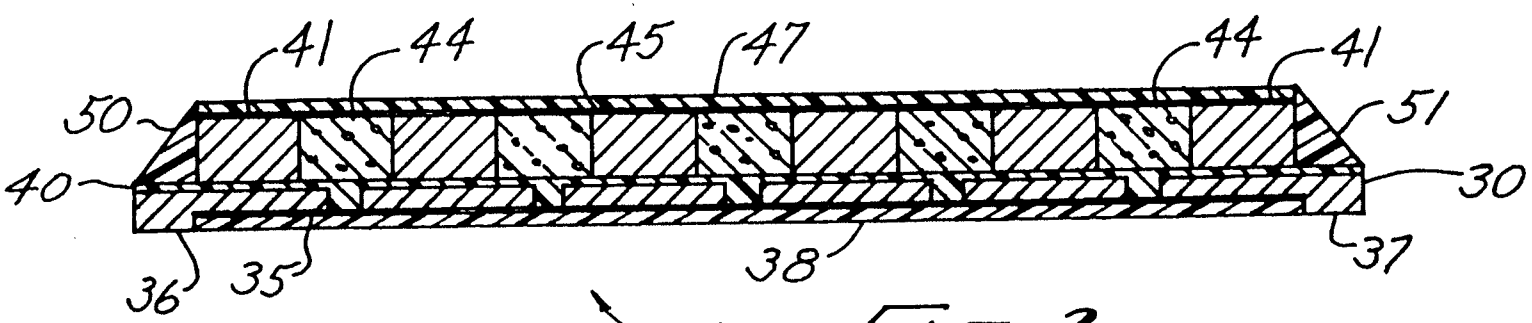
FIG. 3 is a cross section taken at line 3—3 in FIG. 1.

As best shown in FIG. 3, board 10 is a composite structure. While every element of it contributes to its total properties, its primary structural element is a metal base plate 30. This is a stiffly flexible plate, preferably of aluminum. A very useful aluminum alloy is 7075T6, with MRS treatment.

Figure 4:
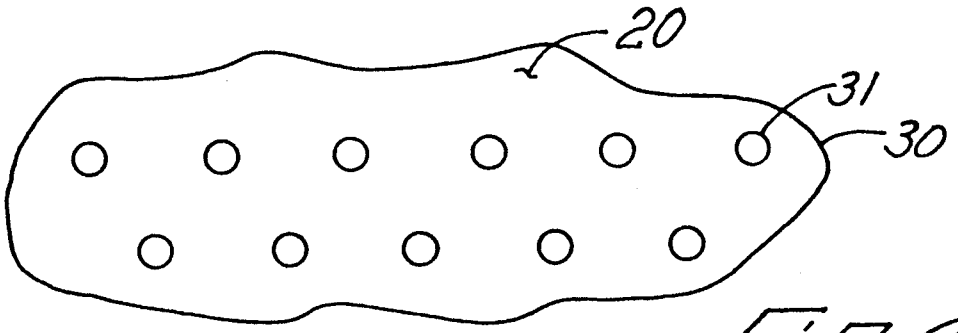
FIG. 4 is a plan view of a portion of the base.

The base plate is preferably hogged from a sheet of material 0.063 inches thick. It is perforated with a substantial number of circular perforations 31 arrayed in a staggered pattern as shown in FIG. 4. The size and distribution of these holes is arbitrary, but a spacing apart of rows of hole centers by 3 inches along the longitudinal axis, and about 5/16 inches on center laterally, for holes about ⅛ inch diameter is useful. Holes up to ¼ inches diameter suitably spaced have been found to be useful. The purpose of these perforations is to reduce random distortions of the base plate. When relieved by these perforations, the base plate acts almost as a chain link structure would act, tending to minimize random distortions.

Of importance to this invention is a recess 35 formed in the base plate between the runners. This recess can be formed by mechanical milling or preferably by chemical milling, usually before the perforations are formed. This recess leaves bottom facing bottom running surfaces 36 and 37 exposed at each side of the snowboard from tip to tail. In one useful snowboard, the recess is 0.033 inches deep in a 0.063 inch thick plate. Surfaces 36 and 37 remain uncoated.

The best-known means to manufacture the metal plate is first to cut it to plan shape, then bend its tip and tail ends and provide the camber as appropriate, and then to chemically mill the recess. The holes can be drilled before or after these procedures as is most convenient to the manufacturer. While the plate can be formed first and milled later as a useful technique, it appears that preforming it and chemically milling the recess results in a somewhat improved plate.

The terminal edge of this plate constitutes a suitably sharp edge for the intended purposes. Its thickness is sufficient for good strength and wearing properties. In the recess between metal running surfaces 36 and 37 there is a running layer 38 of high density polyethylene, applied as a sheet and bonded in place with a contact type adhesive. This material is exemplary of a plastic surface which when in contact with snow is suitably slick and abrasion resistant. When worn it can readily be cut out and patched, or even resurfaced.

This arrangement provides strong bottom-facing running surfaces and running layer, and a strong side edge, with suitable flexibility and springiness for the board as an entire body.

A rubbery adhesive coating 40 is applied to the top face of the metal plate. It flows into and closes the perforations. This coating should be strongly adherent to the metal.

Atop coating 40, a succession of wood strips 41 and intermediate foam strips 44 are applied. The wood strips are cemented to coating 40. The foam strips are preferably foamed in place.

The wood is selected from those commonly used in light airframe construction, such as poplar or spruce, spruce being preferred for its lightweight and for its long continuous grain structure. Wood strips about 1 inch wide and about 3/16 inches thick are useful. The spaces between then will be filled with the foam.

The wood strips are continuous from tip to tail, and a wood strip is at each edge. The center strips are relatively straight, while the side strips are cut to a constant width to follow the edge from tip to tail.

The foam is preferably a two-part closed cell urethane, preferably when in place 12 pound grade. It is preferably pressurized and compressed in place. In any event, it is a relatively hard, but still stiffly flexible, lightweight body.

The strips are overlaid with an adherent epoxy adhesive layer 45 which closes the strips against water intrusion, and also binds a cover 47 to the board.

Cover 47 must not only accomodate considerable distortion forces, but will be stepped on and roughly treated at times. For this reason it is preferably formed of an epoxy resin-impregnated cloth of carbon-carbon and Kevlar. This is an attractive layer which can have internal decoration atop the cloth and beneath a layer of the epoxy material.

The edges of the board are finished with rail members 50,51 which extend from tip to tail. These are wedge shaped, and flare into the edges of the base plate where they project beyond the wood strips to join with it to form a sharp edge. The rail members must be abrasion and impact resistance and serve as a finishing shape for the edges of the wood strips. It is preferably a high density polyethylene plastic.

The foregoing describes the basic construction of the board material. The gross shape of the board is subject to the designer's concepts. In the preferred embodiment, the dimensions are as follows, in inches:

a—7¾
b—6¾
c—51½
d—11½
e—16½
f—6½
g—13
h—13

The radius of the tip and tail sections have their center at their intersection with the center section 20 to provide for the joggle.

The camber in the longitudinal axis is about ¼ inches to ⅛ rise in the middle of the board when the board is unloaded, from end to end of central section 20. The board will flatten under sufficient load.

Two bindings (not shown)for the rider's boots will be mounted to the top of the board where desired.

Figure 5:
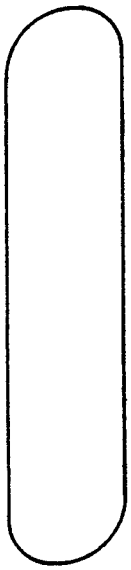
FIG. 5 is a plan view of another embodiment of the invention.

The board shown in FIG. 1 is symmetrical. By this is meant that the running edges of both sides are aligned. FIG. 5 shows a board 60 whose left hand running edge 61 is longitudinally stepped behind its right hand running edge 62. This arrangement could be reversed. Some maneuvers can better be achieved with such arrangements. Also, some persons will prefer to lean more to the left or right, and this arrangement is favorable to them.

It is a significant advantage of this invention that the edge surfaces will not separate from the board. Such separation is a substantial problem, and is frequently encountered by persons who rent out boards. The edges and edge surfaces in this invention are tightly bonded to the board as a consequence of being a continuation of the base plate which extends entirely across the board. There is no gap or interface at which this edge can separate.

If desired, the longitudinal edges of the board can be concavely scalloped in so as to narrow the board near its middle, relative to its maximum width at its ends.

This invention is not to be limited by the embodiment shown in the drawings or described in the description which is given by way of example and not of limitation but only in the scope of the appended claims.

I claim:

1. A snowboard for supporting a rider in his sliding progression along a slick surface such as snow or ice, both of the rider's feet being bound to the snowboard, said snowboard having a longitudinal axis of forward motion and a lateral axis normal to it, said snowboard comprising an integral composite as follows:

a metal base plate having a longitudinally extending top surface and bottom surface, said base plate having a pair of converging side edges, and on its bottom running surfaces that extend along the edges of said plate, a recess being formed in the plate between the running surfaces;

a running layer of plastic material adherent to said metal plate in said recess, extending between said bottom running surfaces;

a plurality of laterally-spaced apart wood strips adhered to the top surface of the metal plate with one of said wood strips adjacent to each edge of said metal plate;

a foam strip adhered to said top surface between each pair of adjacent wood strips;

a cover atop and adherent to said strips extending across the top of the snowboard; and a rail member adherent to said top surface of said plate and to its nearest wood strip, said rail member being smooth and formed of a slick plastic material to form with one edge of said metal plate a running edge.

2. A snowboard according to claim 1 in which said recess is formed by a chemical milling process.

3. A snowboard according to claim 1 in which the snowboard at its tip end and at its tail end is tipped upward.

4. A snowboard according to claim 1 in which the snowboard has a central portion between its tip end and its tail end in which its side edges are substantially parallel to one another.

5. A snowboard according to claim 4 in which the edges at the tip end and at the tail end taper toward one another.

6. A snowboard according to claim 4 in which the snowboard at its tip end and at its tail end is tipped upward.

7. A snowboard according to claim 1 in which the metal plate is pierced by a plurality of perforations.

8. A snowboard according to claim 7 in which said perforations are disposed in laterally aligned rows.

9. A snowboard according to claim 1 in which said wood strips are made of wood having a long grain aligned substantially longitudinally, and in which the foam is a closed-cell urethane.

10. A snowboard according to claim 1 in which said rail members tapers away from said edge to join with the respective edge of said metal plate to form a relatively sharp active edge for the snowboard.

11. A snowboard according to claim 1 in which said running layer is a plastic material bonded to the bottom of the base plate within said recess.

12. In a snowboard having a longitudinal axis of forward motion and a lateral axis normal to it, a tip end and a tail end, said snowboard having a bottom-facing surface for riding on a slick surface such as snow or ice, and a top surface on which a rider is to stand, the improvement comprising:

a metal base plate substantially coextensive with said snowboard in its longitudinal and lateral dimensions, and having dimensions of thickness, an upwardly-facing face and a downwardly-facing face having a flat bottomed recess sunk therein, spaced from a perimetral edge of the plate, said recess having longitudinal edges, said dimensions of thickness of the plate being smaller within said recess, and larger laterally from it so as to form at each of its said longitudinal edges an integral and continuous downwardly extending edge portion having an exposed downwardly facing running surface at each side of said snowboard, said edge portion extending to a level below that of the base of said recess and having a substantial lateral width from respective said longitudinal edge of said recess, said running surfaces thereby being the exposed portion of a laterally undistorted plate; and a plastic sheet bonded in said recess, extending between said running surfaces.

13. A snowboard according to claim 12 in which said recess is formed by a mechanical milling process.

14. A snowboard according to claim 12 in which said recess is formed by a chemical milling process.

15. A snowboard according to claim 14 in which said base plate is an aluminum alloy.

16. A snowboard according to claim 12 in which perforations are formed in said base plate to reduce local distortions under load.

* * * * *